US007721470B2

(12) United States Patent
Long

(10) Patent No.: US 7,721,470 B2
(45) Date of Patent: May 25, 2010

(54) MAGNETIC SHOE ATTACHMENT

(76) Inventor: Marlo T. Long, 1707 NW. Willowbrook Dr., Blue Springs, MO (US) 64015

( * ) Notice: Subject to any disclaimer, the term of this patent is extended or adjusted under 35 U.S.C. 154(b) by 745 days.

(21) Appl. No.: 11/567,267

(22) Filed: Dec. 6, 2006

(65) Prior Publication Data

US 2007/0151084 A1 Jul. 5, 2007

Related U.S. Application Data

(60) Provisional application No. 60/756,248, filed on Jan. 4, 2006.

(51) Int. Cl.
*A43B 23/00* (2006.01)

(52) U.S. Cl. ..... 36/136

(58) Field of Classification Search ..... 36/136
See application file for complete search history.

(56) References Cited

U.S. PATENT DOCUMENTS 5,369,899 A * 12/1994 Reeves ..... 40/1.5
5,740,557 A * 4/1998 Reid et al. ..... 2/209.13
6,006,455 A * 12/1999 Miller ..... 40/1.6
6,163,889 A * 12/2000 Tate ..... 2/209.13
6,671,986 B2 * 1/2004 Reeves ..... 40/1.6
6,729,058 B2 * 5/2004 Ferguson ..... 40/636
6,748,602 B1 * 6/2004 Barnes ..... 2/132
6,880,270 B2 * 4/2005 Prather ..... 36/50.1
6,925,656 B2 * 8/2005 Henderson ..... 2/310
7,140,047 B2 * 11/2006 Kronenberger ..... 2/209.13
2003/0101625 A1 * 6/2003 Wu ..... 36/136
2003/0192206 A1 * 10/2003 Ashton ..... 36/127
2005/0198872 A1 * 9/2005 Correa ..... 36/136
2007/0245598 A1 * 10/2007 Pawsey ..... 36/136
2008/0289225 A1 * 11/2008 Ali et al. ..... 36/70 R

* cited by examiner

*Primary Examiner*—Marie Patterson
(74) *Attorney, Agent, or Firm*—Hovey Williams LLP

(57) ABSTRACT

Embodiments of the present invention provide a magnetic attachment (10) having a first magnetic portion (12) operable to be positioned on the inside of a clothing article and a second magnetic portion (14) operable to be positioned on the outside of the clothing article and coupled therewith through magnetic force. The attachment (10) also includes a decorative element (20) coupled with the second magnetic portion (14). Such a configuration allows clothing articles, including shoes and purses, to be easily decorated without damaging the articles or interfering with their use.

16 Claims, 4 Drawing Sheets

MAGNETIC SHOE ATTACHMENT

RELATED APPLICATION

The present non-provisional application claims the benefit of U.S. Provisional Application No. 60/756,248, entitled "MAGNETIC SHOE ATTACHMENT," filed Jan. 4, 2006. The identified provisional application is incorporated herein by specific reference.

BACKGROUND OF THE INVENTION

1. Field of the Invention

Embodiments of the present invention relate to magnetic attachments for clothing apparel. More particularly, various embodiments of the invention provide a magnetic attachment having a first magnetic portion operable to be positioned on the inside of a clothing article and a second magnetic portion operable to be positioned on the outside of the clothing article and coupled therewith through magnetic force.

2. Description of the Related Art

Individuals often desire to modify their clothing and footware with decorative or novelty pieces. For example, decorative and novelty pieces may be affixed to shoes and other apparel using adhesives, clamps, pins, staples, screws, and other permeant and removable fasteners. Unfortunately, such conventional fasteners are difficult to affix and remove from apparel, permanently damage or modify apparel, are bulky and uncomfortable, and/or are aesthetically unpleasing. Thus, known fasteners are limited in their ability to affix decorative or novelty pieces to clothing articles.

SUMMARY OF THE INVENTION

Embodiments of the present invention solve the above-described problems and provide a distinct advance in the art of apparel attachments. More particularly, various embodiments of the invention provide a magnetic attachment having a first magnetic portion operable to be positioned on the inside of a clothing article and a second magnetic portion operable to be positioned on the outside of the clothing article and coupled therewith through magnetic force. Such a configuration allows clothing articles, such as shoes and purses, to be easily decorated without damaging the articles or interfering with their use.

Other aspects and advantages of the present invention will be apparent from the following detailed description of the preferred embodiments and the accompanying drawing figures.

BRIEF DESCRIPTION OF THE DRAWING FIGURES

A preferred embodiment of the present invention is described below with reference to the attached drawing figures, wherein.

Figure 1:
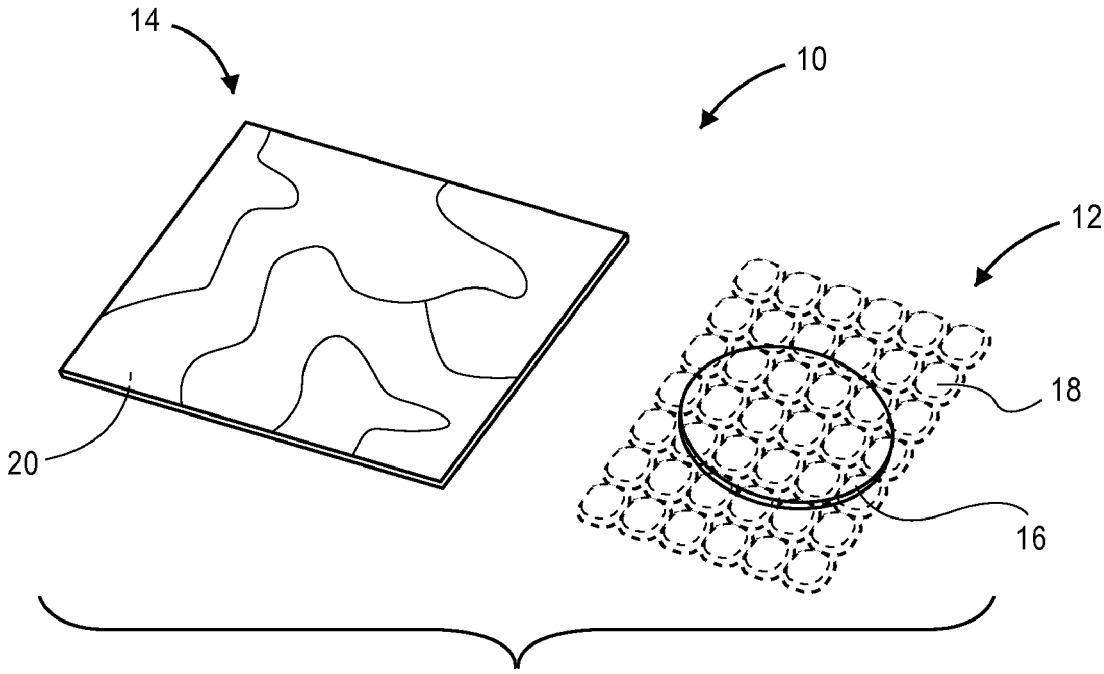
FIG. 1 is a front perspective view of a magnetic attachment configured in accordance with various preferred embodiments of the present invention, the magnetic attachment shown having a first magnetic portion and a second magnetic portion.
Figure 2:
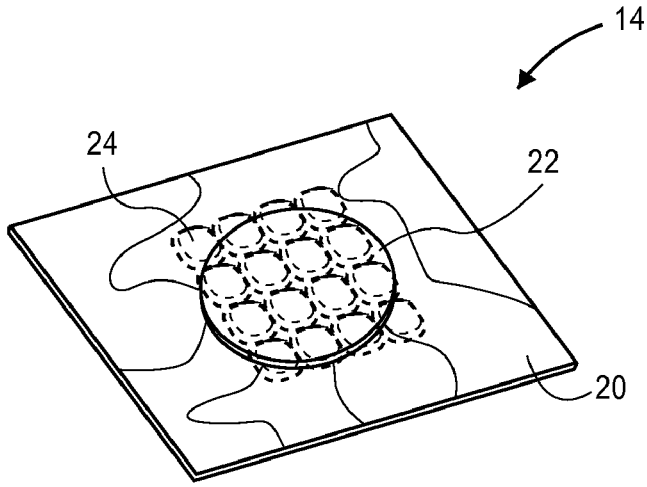
FIG. 2 is a rear perspective view of the second magnetic portion of the magnetic attachment of FIG. 1.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE PREFERRED EMBODIMENTS

The following detailed description of the invention references the accompanying drawings which illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

The present invention generally provides a magnetic attachment 10 operable to couple with a clothing article. The magnetic attachment 10 may couple with any clothing article, including shoes, purses, handbags, hats, shirts, pants, dresses, blouses, skirts, jackets, coats, shorts, combinations thereof, and the like. As discussed below, in various embodiments the magnetic attachment 10 is operable to couple with a shoe S.

The attachment 10 preferably includes a first magnetic portion 12 and a second magnetic portion 14 operable to couple with the first magnetic portion 12 utilizing magnetic force. The first magnetic portion 12 is operable to be positioned inside of the clothing article, such as inside the shoe S, and the second magnetic portion 14 is operable to be positioned outside of the clothing article, such as on an exterior surface of the shoe S. Such a configuration enables the shoe S, or any other clothing article, to be easily modified without damaging or permanently altering the shoe S and without rendering the shoe S uncomfortable.

The first magnetic portion 12 preferably includes a first magnet 16 and a protective covering 18 enclosing the first magnet 16. The first magnet 16 may comprise any magnetic device, but preferably comprises a permanent magnet, such as a rare Earth or neodymium magnet, a samarium-cobalt magnet, a ceramic magnet, a plastic magnet, a alnico magnet, a combination thereof, etc. In various embodiments, the first magnet 16 may comprise a NdFeB rare earth magnet. As is discussed below in more detail, the first magnetic portion 12 and the second magnetic portion 14 are operable to generate a sufficient amount of magnetic force to securely couple the attachment 10 with the shoe S or other potentially thick and dense clothing articles. Thus, the first magnet 16 is preferably sized and configured to provide a sufficient amount of magnetic force to couple the attachment 10 to the shoe S. In various embodiments, the first magnet 16 may comprise a ½ inch by ⅛ inch rare earth magnet or a ¾ inch by ⅛ inch rare earth magnet. As should be appreciated by those skilled in the art, various sized magnets may be utilized by embodiments of the present invention to provide the desired magnetic force.

The covering 18 protects the first magnet 16, facilitates coupling of the first magnetic portion 12 with the shoe S, and facilitates comfortable wearing of the shoe S with the attachment 10. As should be appreciated, various magnets, including those comprising the first magnet 16, are often breakable or fragile due to their inherent characteristics. The covering 18 preferably envelops the first magnet 16 to prevent against breakage or damage during use, installation, or storage of the attachment 10. Further, due to the substantial magnetic force provided by the first magnetic portion 12 and the second magnetic portion 14, the covering 18 additionally protects against magnet damage or user injury caused by the first magnetic portion 12 and second magnetic portion 14 quickly joining.

Additionally, the covering 18 protects the interior of the shoe S from damage caused by potentially rough or sharp magnet edges. Specifically, the covering 18 preferably provides a soft or cushioning surface for coupling with the interior portion of the shoe S, thereby reducing or preventing any adverse affects caused by the coupling of the portions 12, 14 to the shoe S. Further, the covering 18 and its soft and cushioning surface prevents damage to stockings, socks, and other materials and appendages that may be inserted into the shoe S.

The covering 18 also enables the first portion 12 to be comfortably worn by a user while positioned in the interior of the shoe S. For instance, as will be appreciated, magnets, including the first magnet 16, are generally hard and could present an uncomfortable surface should the user's foot come in contact with the first magnet 16. The covering 18 envelops the first magnet 16 and provides a soft or cushioning surface, as described above, to enable the first magnetic portion 12 and the first magnet 16 to comfortably abut the user's foot.

Figure 5:
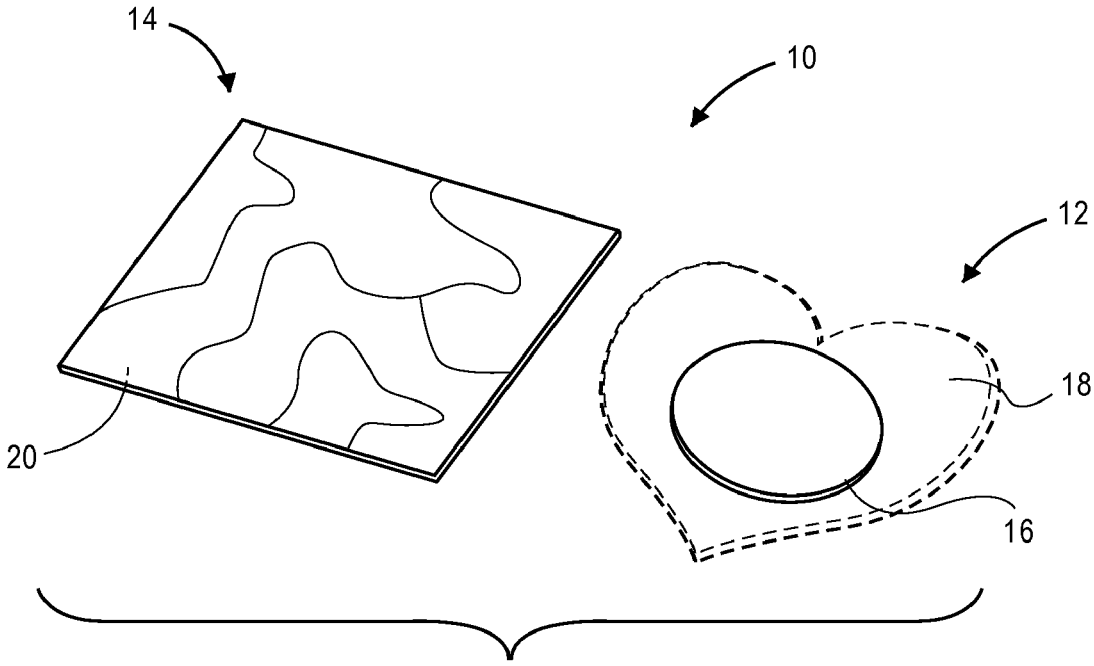
FIG. 5 is a front perspective view of a magnetic attachment configured in accordance with various other preferred embodiments of the present invention, the magnetic attachment shown having a first magnetic portion and a second magnetic portion.

In various embodiments, and as shown in FIG. 5, the covering 18 may present a decorative appearance to facilitate use of the attachment 10. For example, in embodiments where the attachment 10 is placed such that the first magnetic portion 12 is viewable, such as where the attachment 10 is coupled with a purse, it may be desirable to employ a decorative covering to prevent the attachment 10 from negating the aesthetic appeal of the purse or other clothing article.

In embodiments where the clothing article comprises a purse, the covering 18 enables the first portion 12 to be positioned on the inside of the purse without damaging the contents of the purse or causing injury to the user should the user's hand come into contact with the first portion 12. Similarly, in embodiments where the clothing article comprises a shirt or other apparel, the covering 18 prevents the first portion 12 and first magnet 16 from causing user discomfort.

The covering 18 may comprise any soft or cushioning element, including but not limited to, silk, suede, lace, cloth, nylon, rubber, sponges, formed foam materials, gels, etc. In some embodiments, the covering 18 comprises spongy cupboard/drawer liner, such as the "Mainstays Home" Non-Adhesive Non-Slip Liner distributed by WAL-MART. Utilization of spongy drawer liner enables the covering 18 and first magnet portion 12 to be easily formed by sewing and/or adhesive. For example, the first magnet 16 may be positioned on the covering 18 and the covering 18 may be folded over the first magnet 16 and affixed with glue to envelop the first magnet 16. However, in other embodiments the covering 18 may comprise a soft pouch having a slit for receiving the first magnet 16.

The second magnetic portion 14 is operable to be positioned on the exterior of the shoe S or other clothing article. The second magnetic portion 14 generally includes a decorative piece 20, a second magnet 22, and a protective layer 24. The second magnet 22 is coupled with the decorative piece 20 and the protective layer 24 is coupled with the second magnet 22 to enable the second magnet 22 to magnetically couple with the first magnet 16 through the shoe S to safely and securely affix the decorative piece 20 to the shoe S.

The decorative piece 20 may include any decorative or novelty element, including stones, jewelry, logos, cloth, electronic devices, buttons, photos, etc. The decorative piece 20 preferably includes a front for facing away from the shoe S and a rear for coupling with the second magnet 22. Preferably, the decorative piece 20 is sized and configured to aesthetically couple with the second magnet 22, such that the decorative piece 20 is not substantially smaller than the second magnet 22. Due to the strength of the magnetic coupling provided by the first and second portions 12, 14, the decorative piece 20 may be substantially larger and heavier than the second magnet 22.

The second magnet 22 is substantially similar or identical to the first magnet 16 discussed above. Thus, the second magnet 22 may comprise any magnetic device, but preferably comprises a permanent magnet, such as a rare Earth or neodymium magnet, a samarium-cobalt magnet, a ceramic magnet, a plastic magnet, a alnico magnet, a combination thereof, etc. The second magnet 22 may also be sized differently the first magnet 16 to facilitate coupling the second magnet 22 with the decorative piece 20.

The second magnet 22 in combination with the first magnet 16 is operable to provide sufficient magnetic force to couple both magnets 16, 22 to the shoe S, or other clothing articles, though potentially thick materials, such as cloth, leather, rubber, etc. Thus, the first magnet 16 and second magnet 22 are preferably sized and configured to enable coupling through a predetermined distance, such as ½ inch or 1 inch, to ensure that the attachment 10 may couple with any shoe S or clothing article.

The second magnet 22 is preferably permanently coupled with the decorative piece 20 utilizing adhesives or other permeant fasteners to prevent the decorative piece 20 from disengaging from the attachment 10. However, the second magnet 22 may be removably coupled with the decorative piece 20 to enable the user to easily swap or exchange decorative pieces without detaching the second magnet 22 from the shoe S.

The layer 24 is substantially similar to the covering 18 discussed above, and may be formed of similar or identical materials. However, the layer 24 preferably does not envelop the second magnet 22 to facilitate secure coupling of the second magnet 22 to the decorative piece 20 with adhesive. Thus, the layer 24 preferably comprises a single sheet of material coupled with the second magnet 22 via adhesive.

The layer 24 prevents damage to the shoe S when the second magnetic portion 14 is coupled thereto by providing a soft and cushioning surface for abutting the exterior of the shoe S. Thus, even in the presence of the strong magnetic force that couples the portions 12, 14 together through the shoe S, the second magnetic 22 is prevented from damaging the exterior of the shoe S by the layer 24. Additionally, the layer 24 and the covering 18 prevent user injury and damage to the attachment 10 in the event the portions 12, 14 are rapidly combined, as the soft layer 24 and covering 18 prevent magnet breakage and damage to the user's fingers or other extremities caught between the portions 12, 14. However, in some embodiments the attachment 10 does not include the layer 24.

Figure 3:
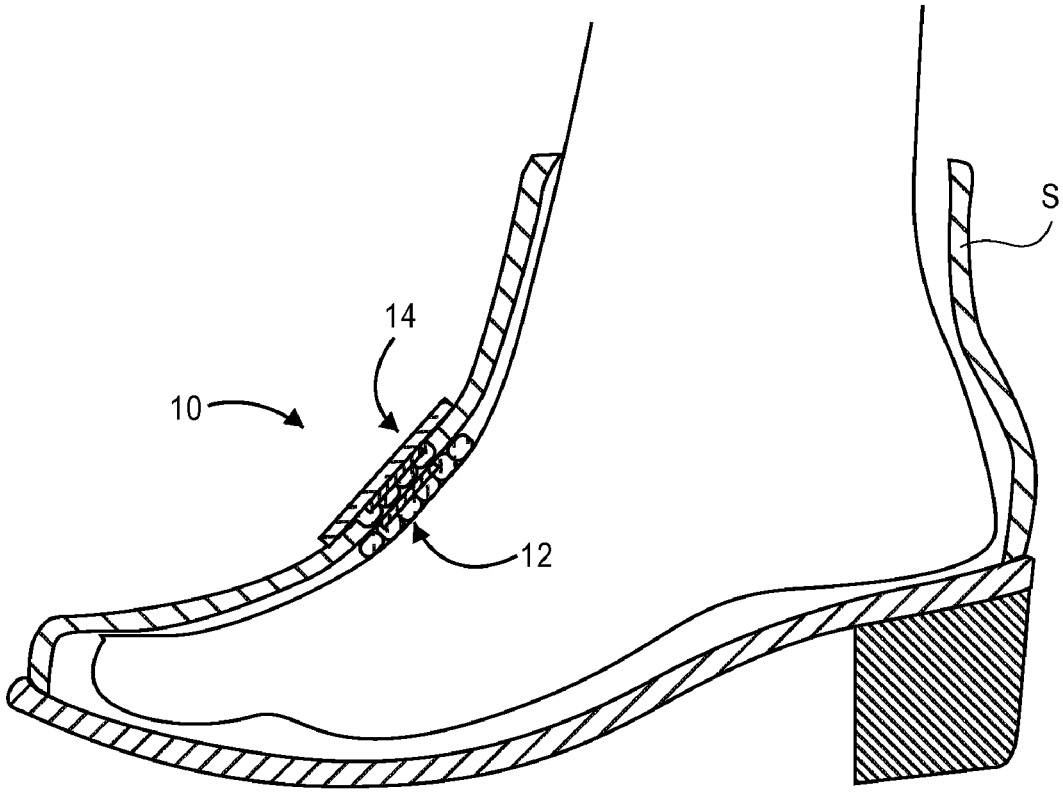
FIG. 3 is a cross sectional view showing the magnetic attachment of FIGS. 1-2 coupled with a shoe, the first magnetic portion shown coupled with an interior portion of the shoe and the second magnetic portion shown coupled with an exterior portion of the shoe.
Figure 4:
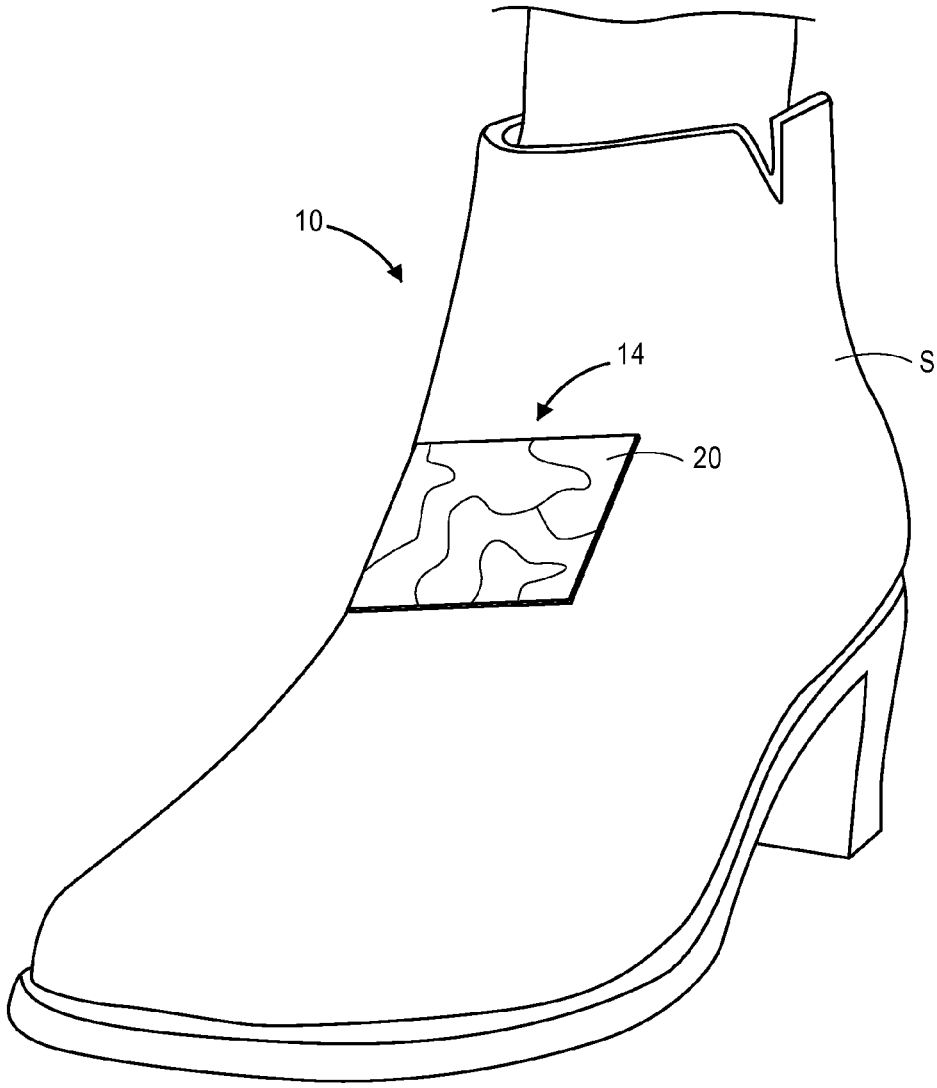
FIG. 4 is a front perspective view of the second magnetic portion of FIGS. 1-3 shown coupled with the exterior of the shoe.

In use, the user inserts the first magnetic portion 12 into the shoe S at a desired location, such as along the tongue, heel, or front of the shoe S. Next, the user positions the second magnetic portion 14 on the exterior portion of the shoe S corresponding to the desired location. As the portions 12, 14 are positioned in proximity to each other through the shoe S, magnetic force is generated between the portions 12, 14 to cause the portions 12, 14 to securely come together, with the shoe S being positioned therebetween. The secure coupling of the portions 12, 14 couples the attachment 10 to the shoe S and enables the decorative piece 20 to be conveniently and easily coupled with the shoe S. Further, due to the covering 18, the first magnetic portion 12 is operable to abut the user's foot and the interior portion of the shoe S, as shown in FIG. 3, without harming either the shoe S or the user's foot.

Similarly, the user may insert the first magnetic portion 12 on one side of any clothing article, such as a purse, and position the second magnetic portion 14 on the other side of the clothing article to couple the decorative element 20 thereto.

Although the invention has been described with reference to the preferred embodiment illustrated in the attached drawing figures, it is noted that equivalents may be employed and substitutions made herein without departing from the scope of the invention as recited in the claims.

Having thus described the preferred embodiment of the invention, what is claimed as new and desired to be protected by Letters Patent includes the following:

The invention claimed is:

1. A magnetic attachment for removably coupling with a shoe having an inside and an outside, the magnetic attachment comprising:

a first magnetic portion operable to be removably positioned on the inside of the shoe;

a covering at least partially enveloping the first magnetic portion; and a second magnetic portion operable to be removably positioned on the outside of the shoe to magnetically and removably couple a decorative element to the shoe.

2. The magnetic attachment of claim 1, wherein the covered first magnetic portion is operable to be positioned inside the shoe without interfering with a wearer's use of the shoe.

3. The magnetic attachment of claim 1, further including a protective layer coupled with the second magnetic portion opposite the decorative element to protect the shoe when the second magnetic portion is coupled thereto.

4. The magnetic attachment of claim 1, wherein the first magnetic portion and second magnetic portion each include a NdFeB rare earth magnet.

5. The magnetic attachment of claim 1, wherein the first magnetic portion is approximately one-eighth inch thick and between approximately one-half and three-fourth inches wide.

6. The magnetic attachment of claim 1, wherein the decorative element is fixedly attached to the second magnetic portion.

7. The magnetic attachment of claim 1, wherein the decorative element is removably attached to the second magnetic portion.

8. The magnetic attachment of claim 1, wherein the covering fully envelops the first magnetic portion.

9. The magnetic attachment of claim 1, wherein the covering comprises a substantially soft material to prevent damage to the shoe or a wearer of the shoe.

10. A magnetic attachment for removably coupling with a shoe having an inside and an outside, the magnetic attachment comprising:

a first magnetic portion comprising a rare earth magnet and operable to be removably positioned on the inside of the shoe;

a soft covering at least partially enveloping the first magnetic portion; and a second magnetic portion comprising a rare earth magnet and operable to be removably positioned on the outside of the shoe to magnetically and removably couple a decorative element to the shoe.

11. The magnetic attachment of claim 10, further including a protective layer coupled with the second magnetic portion opposite the decorative element to protect the shoe when the second magnetic portion is coupled thereto.

12. The magnetic attachment of claim 10, wherein the first magnetic portion and second magnetic portion each include a NdFeB rare earth magnet.

13. The magnetic attachment of claim 10, wherein the first magnetic portion is approximately one-eighth inch thick and between approximately one-half and three-fourth inches wide.

14. The magnetic attachment of claim 10, wherein the decorative element is fixedly attached to the second magnetic portion.

15. The magnetic attachment of claim 10, wherein the soil covering is a decorative covering.

16. A method of removably attaching a decorative element in a shoe having an inside and an outside, the method comprising:

removably positioning a first magnetic portion on the inside of the shoe; and removably positioning a second magnetic portion on the outside of the shoe, the second magnetic portion having the decorative element coupled thereto, the first and second magnetic portions being positioned such that the decorative element is removably and magnetically coupled to the shoe.

* * * * *